US010953663B2

(12) United States Patent
Miyashige et al.

(10) Patent No.: US 10,953,663 B2
(45) Date of Patent: Mar. 23, 2021

(54) THERMAL HEAD

(71) Applicant: AOI Electronics Co., Ltd., Takamatsu (JP)

(72) Inventors: Michihiro Miyashige, Mitoyo (JP); Noriaki Onishi, Kagawa (JP); Norio Yamaji, Zentsuji (JP)

(73) Assignee: AOI Electronics Co., Ltd., Takamatsu (JP)

( * ) Notice: Subject to any disclaimer, the term of this patent is extended or adjusted under 35 U.S.C. 154(b) by 0 days.

(21) Appl. No.: 16/606,500

(22) PCT Filed: Jul. 12, 2018

(86) PCT No.: PCT/JP2018/026365
§ 371 (c)(1),
(2) Date: Oct. 18, 2019

(87) PCT Pub. No.: WO2019/064826
PCT Pub. Date: Apr. 4, 2019

(65) Prior Publication Data

US 2020/0122477 A1 Apr. 23, 2020

(30) Foreign Application Priority Data

Sep. 27, 2017 (JP) ..... JP2017-186673

(51) Int. Cl.
*B41J 2/335* (2006.01)

(52) U.S. Cl.
CPC ..... *B41J 2/3353* (2013.01); *B41J 2/3351* (2013.01)

(58) Field of Classification Search
CPC .... B41J 2/3353; B41J 2/3351; B41J 2/33515; B41J 2/33545; B41J 2/3354; B41J 2/3357
USPC ..... 347/203
See application file for complete search history.

(56) References Cited

U.S. PATENT DOCUMENTS

| | | | | |
|---|---|---|---|---|
| 6,081,287 | A | 6/2000 | Noshita et al. | |
| 2010/0085412 | A1* | 4/2010 | Kanei | B41J 2/3353 347/203 |

FOREIGN PATENT DOCUMENTS

| | | | |
|---|---|---|---|
| CN | 101636 275 | A | 1/2010 |
| JP | 4-214367 | A | 8/1992 |
| JP | 5-177857 | A | 7/1993 |
| JP | 5-309855 | A | 11/1993 |
| JP | 6-008501 | A | 1/1994 |

(Continued)

OTHER PUBLICATIONS

International Search Report (PCT/ISA/210) issued in PCT Application No. PCT/JP2018/026365 dated Sep. 25, 2018 with English translation (four (4) pages).

(Continued)

*Primary Examiner* — Huan H Tran
*Assistant Examiner* — Alexander D Shenderov
(74) *Attorney, Agent, or Firm* — Crowell & Moring LLP

(57) ABSTRACT

A thermal head includes: an underglaze layer provided on an insulating substrate; an electrode provided on the underglaze layer; a heat generator provided on the electrode; a first protective layer containing a glass material and covering at least the heat generator; and a second protective layer provided on the first protective layer, having a melting point higher than that of the first protective layer, and made of a material whose thermal expansion coefficient at a temperature of 1000° C. or lower is substantially constant.

9 Claims, 4 Drawing Sheets

(56) References Cited

FOREIGN PATENT DOCUMENTS

| | | | |
|---|---|---|---|
| JP | 6-155793 | A | 6/1994 |
| JP | 2000-153630 | A | 6/2000 |
| JP | 2005-119094 | A | 5/2005 |
| JP | 2008-207439 | A | 9/2008 |

OTHER PUBLICATIONS

Japanese-language Written Opinion (PCT/ISA/237) issued in PCT Application No. PCT/JP2018/026365 dated Sep. 25, 2018 (four (4) pages).
Chinese Office Action dated Sep. 21, 2020.

* cited by examiner

THERMAL HEAD

TECHNICAL FIELD

The present invention relates to a thermal head.

BACKGROUND ART

A wear-resistant protective film that protects a thermal head has heretofore been known (see Patent Literature 1).

CITATION LIST

Patent Literature

PTL1: Japanese Laid-Open Patent Publication H05-177857 A

SUMMARY OF INVENTION

Technical Problem

Conventional techniques have a problem that a sufficient lifetime cannot be achieved particularly in high-speed printing.

Solution to Problem

According to a first aspect of the present invention, a thermal head comprises: an underglaze layer provided on an insulating substrate; an electrode provided on the underglaze layer; a heat generator provided on the electrode; a first protective layer containing a glass material and covering at least the heat generator; and a second protective layer provided on the first protective layer, having a melting point higher than that of the first protective layer, and made of a material whose thermal expansion coefficient at a temperature of 1000° C. or lower is substantially constant.

According to a second aspect of the present invention, in the thermal head according to the first aspect, it is preferable that the second protective layer has a melting point of at least 1000° C. or higher.

According to a third aspect of the present invention, in the thermal head according to the second aspect, it is preferable that the first protective layer and the second protective layer have a thermal expansion coefficient of 6.0 to 7.0 ppm/° C.

According to a fourth aspect of the present invention, in the thermal head according to the third aspect, it is preferable that the second protective layer has a thermal conductivity of 10 W/mK or more.

According to a fifth aspect of the present invention, in the thermal head according to the fourth aspect, it is preferable that the second protective layer has a specific resistance of 100 μΩ·cm or less.

According to a sixth aspect of the present invention, in the thermal head according to the fifth aspect, it is preferable that the second protective layer is made of a material containing titanium and tungsten.

According to a seventh aspect of the present invention, in the thermal head according to the sixth aspect, it is preferable that the first protective layer has a thermal conductivity of more than 10 W/mK.

According to an eighth aspect of the present invention, in the thermal head according to any one of the first to seventh aspects, it is preferable to further comprise a third protective layer provided between the first protective layer and the second protective layer and having ductility higher than those of the first protective layer and the second protective layer.

According to a ninth aspect of the present invention, in the thermal head according to the eighth aspect, it is preferable that the third protective layer is made of a material containing titanium.

According to a tenth aspect of the present invention, in the thermal head according to the eighth or ninth aspect, it is preferable that in a printing surface of the thermal head, the second protective layer and the third protective layer are smaller in a width in a sub-scan direction than the first protective layer, According to an eleventh aspect of the present invention, in the thermal head according to any one of the eighth to tenth aspects, it is preferable that the second protective layer and the third protective layer are formed as thin films by sputtering.

Advantageous Effects of Invention

According to the present invention, it is possible to provide a long-life thermal head.

DESCRIPTION OF EMBODIMENTS

First Embodiment

Figure 1:
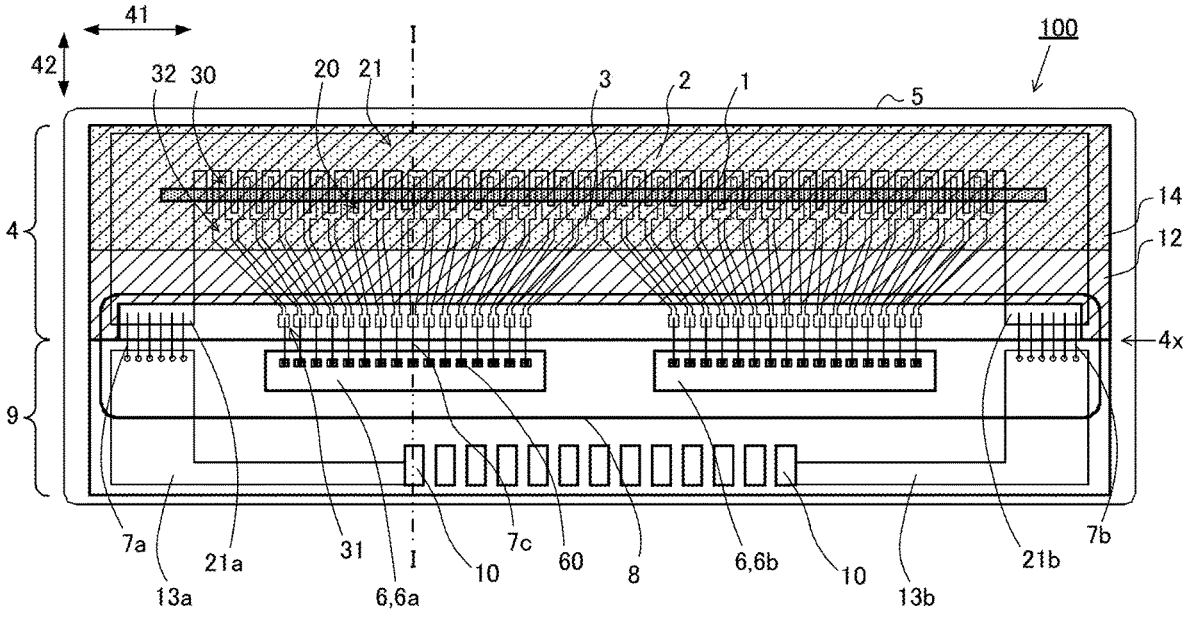
FIG. 1 is a plan view showing the structure of a thermal head according to a first embodiment.
Figure 2:
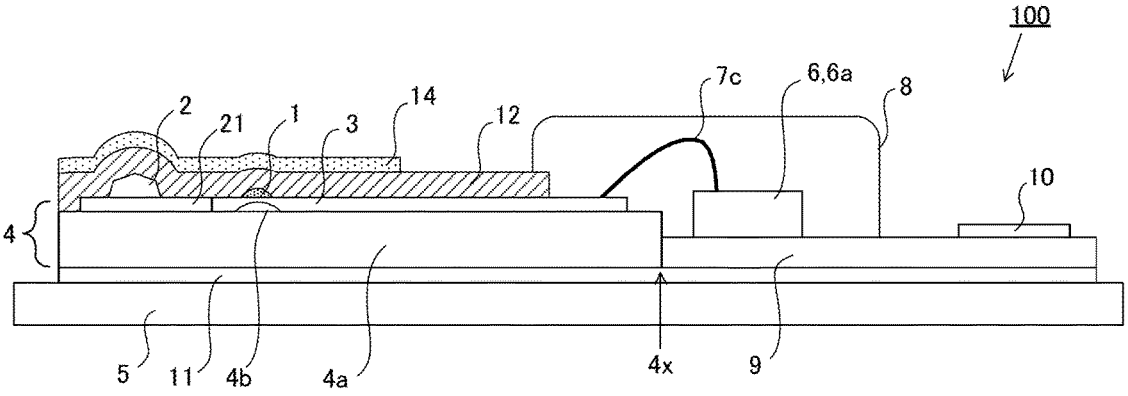
FIG. 2 is a schematic sectional view taken along a line I-I shown in FIG. 1.

FIG. 1 is a plan view showing the structure of a thermal head according to a first embodiment of the present invention. FIG. 2 is a schematic sectional view taken along a line I-I shown in FIG. 1. A thermal head 100 includes a support plate 5 and an insulating substrate 4 and a circuit board 9 which are fixed on the support plate 5. The insulating substrate 4 and the circuit board 9 are fixed on the support plate 5 by an adhesive layer 11.

The insulating substrate 4 is made of an insulator such as ceramic. In this embodiment, the insulating substrate 4 is formed by providing an underglaze layer **4*b* on a ceramic substrate 4*a*. On the insulating substrate 4, a common electrode base 21 and a plurality of individual electrodes 3 are formed by, for example, removing unnecessary portions from a conductor such as gold by photolithographic etching. On the top (on the upper side in the plane of sheet of FIG. 2) of the common electrode base 21 and the individual electrodes 3, a band-shaped heat generator (or heat element) 1 is formed by, for example, thick film printing. In this embodiment, the underglaze layer 4*b* having a certain curvature is provided under the heat generator 1**.

On the circuit board 9 such as a printed circuit board, a driver IC **6*a*, a driver IC 6*b*, and connecting terminals 10 are provided. Each of the driver IC 6*a* and the driver IC 6*b* is a driver IC that is connected to the individual electrodes 3 and controls the passage or non-passage of electric current through the heat generator 1. In the following description, the driver IC 6***a* and the driver IC 6*b* are collectively called driver ICs 6.

The connecting terminals 10 are connecting members for connecting the thermal head 100 to an external device that performs, for example, printing control. The connecting terminals 10 are provided in line in the lower part of the circuit board 9 in FIG. 1, that is, along the edge of the circuit board 9 opposite to the edge near the insulating substrate 4. One end of each of the individual electrodes 3 is connected to the driver IC 6 through a wire 7*c*. The wire 7*c* is a metallic wire, such as a gold wire, that electrically connects the individual electrode 3 and the driver IC 6.

A common electrode 2 has the common electrode base 21 and a plurality of common electrode extensions 20. The common electrode base 21 is formed along three out of four edges of the rectangular insulating substrate 4 other than the edge facing the circuit board 9 so as to surround the heat generator 1. The common electrode extensions 20 extend along a sub-scan direction 42 (in the vertical direction in the plane of sheet of FIG. 1) from an area of the common electrode base 21 that extends in parallel with the heat generator 1 in FIG. 1. As will be described later, the heat generator 1 extends in a direction parallel to a main scan direction 41.

One end 21*a* of the common electrode base 21 is electrically connected to a wiring pattern 13*a* provided on the circuit board 9 through wires 7*a*. The wiring pattern 13*a* is electrically connected to any of the connecting terminals 10. The other end 21*b* of the common electrode base 21 is electrically connected to a wiring pattern 13*b* provided on the circuit board 9 through wires 7*b*. The wiring pattern 13*b* is electrically connected to any of the connecting terminals 10.

Each of the individual electrodes 3 has a connecting part 32, an individual electrode extension 30, and a connecting pad 31. The individual electrode extension 30 is located between a pair of the common electrode extensions 20 of the common electrode 2 and extends along the sub-scan direction 42. The connecting part 32 extends from the end of the individual electrode extension 30 in the sub-scan direction 42.

The connecting pad 31 is provided at another end of the connecting part 32, that is, at an end of the connection part 32 opposite to the individual electrode extension 30. That is, the individual electrode extension 30 is provided at one end of the connecting part 32, and the connecting pad 31 is provided at the other end of the connecting part 32. In other words, the individual electrode extension 30 and the connecting pad 31 are connected through the connecting part 32.

The common electrode extensions 20 and the individual electrode extensions 30 are alternately formed so as to face to and mesh with each other. The heat generator 1 is formed across the common electrode extensions 20 and the individual electrode extensions 30. In other words, the heat generator 1 crosses the common electrode extensions 20 and the individual electrode extensions 30, and extends in the main scan direction 41 (in the horizontal direction in the plane of sheet of FIG. 1) in which the common electrode extensions 20 and the individual electrode extensions 30 are arranged.

The connecting pads 31 are arranged in line with a predetermined pitch along an edge 4*x* (FIG. 1, FIG. 2) of the insulating substrate 4 near the circuit board 9, that is, along the main scan direction 41. The driver ICs 6 have a slim rectangular shape when viewed from above (elongated quadrangular prism as a whole), and are die-bonded to the circuit board 9 so as to be aligned in such a manner that their longitudinal direction is parallel to a direction in which the edge 4*x* near the circuit board 9 extends. On the top surface of each of the driver ICs 6, a plurality of IC electrode pads 60 are provided along the edge facing the insulating substrate 4, that is, along the main scan direction 41. The connecting pads 31 are arranged with the same pitch as the IC electrode pads 60. One IC electrode pad 60 corresponds to one connecting pad 31. Each of the connecting pads 31 is electrically connected to its corresponding IC electrode pad 60 through the wire 7*c*.

The driver ICs 6 control electric current that flows from the common electrode 2 to each of the individual electrodes 3 through the heat generator 1. This allows electric current to flow into micro areas of the heat generator 1 located between the common electrode extensions 20 and the individual electrode extensions 30 alternately formed so as to face to and mesh with each other so that such areas produce heat. The heat is given to a printing medium such as thermal paper to perform printing.

It is to be noted that in FIG. 1, for convenience of illustration, the individual electrodes 3 are simply shown so that the number of the individual electrodes 3 is smaller than in reality. Therefore, the number of the common electrode extensions 20, the number of the individual electrode extensions 30, the number of the connecting pads 31, and the number of the IC electrode pads 60 in FIG. 1 are also smaller than in reality.

Part of the entire insulating substrate 4 except for the edge 4*x* is covered with a thick film protective film 12 indicated by hatching in FIG. 1 and FIG. 2. The thick film protective film 12 is mainly made of, for example, a glass material, and has a thickness of about 4 to 10 μm, a thermal expansion coefficient of about 6.0 to 6.7 ppm/° C., and a thermal conductivity of less than 10 w/m·K. The thick film protective film 12 has a certain surface roughness to enhance adhesion to a thin film protective film 14. Experimentally, Ra is preferably in the range of 0.1 to 0.2 μm.

Part of the entire thick film protective film 12 located on the upper side in the plane of the sheet so as to cover the heat generator 1 is covered with the thin film protective film 14 indicated by dots in FIG. 1 and FIG. 2. The thin film protective film 14 is made of, for example, an alloy containing 10% by weight of titanium and 90% by weight of tungsten. The thin film protective film 14 has a thickness of about 4 μm, a thermal expansion coefficient of about 6.0 ppm/° C., a thermal conductivity of about 13.6 w/m·K, an almost constant thermal expansion coefficient at a temperature of 1000° C. or lower, and a melting point of 1000° C. or higher. The thin film protective film 14 is formed by, for example, a thin film forming device such as a sputtering device.

A sealing resin 8 is provided across the insulating substrate 4 and the circuit board 9 to seal a boundary area between the insulating substrate 4 and the circuit board 9 including the driver ICs 6, the wires 7*a*, the wires 7*b*, and the wires 7*c*. The sealing resin 8 prevents the wires 7*a*, the wires 7*b*, the wires 7*c*, etc. from being broken or removed by external contact or impact.

Figure 3:
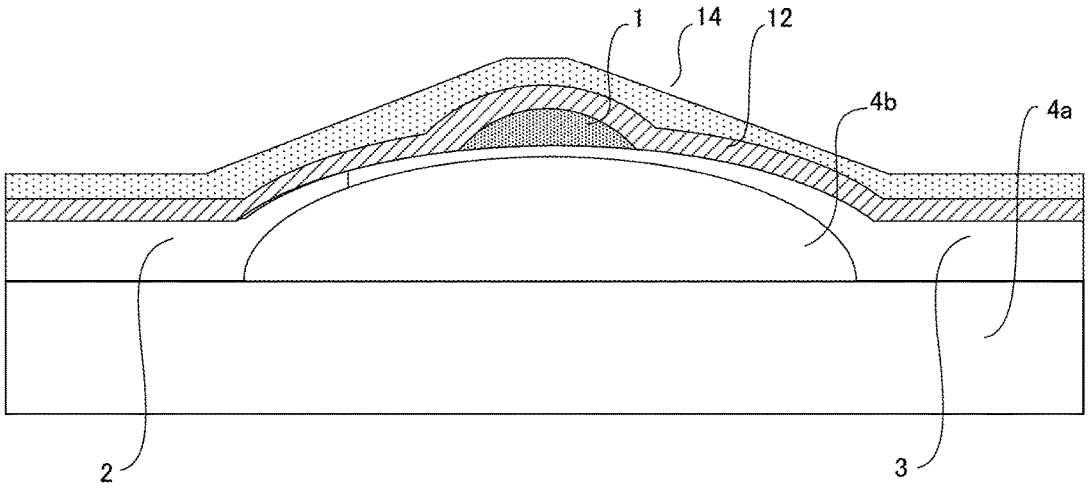
FIG. 3 is a schematic view showing the cross-section structure of a protective film in detail.

FIG. 3 is a schematic view showing the cross-section of an area near the heat generator 1. On part of the ceramic substrate 4*a* that is a base of the insulating substrate 4, the underglaze layer 4*b* having a certain curvature is formed. On the underglaze layer 4*b* and part of the ceramic substrate 4*a* on which the underglaze layer 4*b* is not formed, the common electrode base 21 and the individual electrodes 3 are formed, and the heat generator 1 is formed thereon. On the heat generator 1, the common electrode 2, the common electrode base 21, and the individual electrodes 3, the thick film protective film 12 is formed to cover them. On the thick film protective film 12, the thin film protective film 14 is formed by, for example, sputtering.

A printing operation is basically performed per printing cycle generally performed on each element array of the heat generator 1. The printing cycle is a combination of the time to pass electric current through the heat generator 1 and the time not to pass electric current through the heat generator 1. The temperature of the thick film protective film 12 and the thin film protective film 14 formed on the top of the heat generator 1 increases when electric current is passed through the heat generator 1, and on the other hand decreases when electric current is not passed through the heat generator 1. At this time, there is a case where a peak temperature during temperature rise exceeds about 300° C., and the difference between the peak temperature during temperature rise and a bottom temperature during temperature decrease is as large as about 250° C. In the present invention, as the uppermost protective layer, the thin film protective film 14 is formed which has an almost constant thermal expansion coefficient at a temperature of 1000° C. or lower and a melting point of 1000° C. or higher. This makes it possible to provide a sufficient margin against possible mechanical deformation of the thin film protective film 14 caused due to the amount of heat transferred to the thin film protective film 14.

Stress is generated by expansion and contraction caused per printing cycle due to the difference in the amount of heat between the peak temperature and the bottom temperature of the thick film protective film 12 and the thin film protective film 14 provided on the top of the heat generator 1. However, in the present invention, the thick film protective film 12 and the thin film protective film 14 have almost the same thermal expansion coefficient, and therefore behave almost the same way during the above-described expansion and contraction caused due to the amount of heat. This makes it possible to reduce stress caused by the difference in thermal expansion between the thick film protective film 12 and the thin film protective film 14, thereby obtaining a stronger adhesive force.

The thin film protective film 14 has a high melting point and high thermally conductivity, and therefore has improved resistance to energy to be applied. It has experimentally been confirmed that resistance to energy is improved by 50% or more as compared to when the thin film protective film 14 is made of a thick-film material.

The thin film protective film 14 used in the present invention has a specific resistance of 53.6 μΩ·cm, and therefore also has improved resistance to static electricity applied as a disturbance. It has experimentally been confirmed that resistance to static electricity is 15 kV or more when the thin film protective film 14 provided on the heat generator is subjected to contact discharge at discharge constants of 330Ω, 150 pF.

When printing paper slides in a state where the thermal head 100 is pressed with a platen roller, there is a possibility that foreign matter such as dust enters the thermal head 100 as a disturbance. Such foreign matter may damage the thin film protective film 14.

According to this embodiment, it is possible to provide the thermal head 100 having a long lifetime and high reliability because the thin film protective film 14 is made of titanium-tungsten having toughness, and therefore even when foreign matter such as dust enters the thermal head 100, it is possible to retard the growth of flaws interfering with printing in the depth direction.

That is, according to the above-described embodiment, the following operational effects can be obtained.

(1) The heat generator 1 is covered with the thick film protective film 12 containing a glass material, and the thin film protective film 14 containing titanium and tungsten and having a high melting point is provided on the thick film protective film 12. This makes it possible to provide a thermal head 100 having high reliability.

(2) The thin film protective film 14 has a high melting point and a high thermal conductivity, and therefore resistance to energy to be applied can be improved and appropriate printing can be performed even on printing paper poor in sensitivity.

(3) The thin film protective film 14 is made of titanium-tungsten having metallic properties, and therefore it is possible to provide a thermal head 100 having resistance to static electricity and high reliability.

Second Embodiment

Hereinbelow, a thermal head 100 according to this embodiment will be described by focusing on a difference from the thermal head 100 according to the first embodiment.

The thermal head 100 according to the second embodiment is different from that according to the first embodiment in that the thick film protective film 12 has a higher thermal conductivity. More specifically, the thick film protective film 12 has a thermal conductivity of, for example, 10 w/m·K or more. Preferably, the thermal conductivity of the thick film protective film 12 is, for example, 16 w/m·K or more.

The printing speeds of printers recently tend to be higher, and there is a case where the printing speed is 350 mm/sec or higher. In this case, the printing cycle is shorter (357 μs/printing cycle when the printing speed is 350 mm/sec and the printing density in the sub-scan direction is 8 lines/mm), and therefore the peak temperature of each element of the heat generator 1 shows a steep curve with time, and the bottom temperature during temperature decrease does not completely drop to room temperature so that heat is more likely to accumulate. It has experimentally been confirmed that when energy is continuously applied to each element unit of the heat generator 1 every printing cycle, the peak temperature of part of the thin film protective film 14 located above the heat generator 1 reaches 400 to 500° C. or higher due to heat accumulated by the application of energy. Here, the thin film protective film 14 is formed as a thin film of titanium-tungsten by, for example, sputtering, and therefore a relatively large internal stress is present therein. Further, the surface roughness Ra of the surface of the thick film protective film 12 adhering to the thin film protective film 14 is adjusted to about 0.1 to 0.2 μm so that the surface of the thick film protective film 12 has an anchor effect to achieve adhesion between the thin film protective film 14 and the thick film protective film 12 as a lower layer even when internal stress is present in the thin film protective film 14. It has experimentally been confirmed that static bonding can sufficiently be achieved by this surface roughness. However, when heat is applied during a printing operation, there is a fear that internal stress is locally disturbed by thermal expansion and contraction at anchor portions near the interface between the thin film protective film 14 and the thick film protective film 12 so that adhesive force is reduced, because the surface roughness of the thick film protective film 12 creates a condition where anchors are embedded in the thin film protective film 14. In this embodiment, the thick film protective film 12 has a high thermal conductivity of 16

W/m·K, and therefore heat transferred from the heat generator 1 is less likely to accumulate in the thick film protective film 12 so that the thick film protective film 12 is less likely to expand or contract, and sufficient adhesive force between the thin film protective film 14 and the thick film protective film 12 can be obtained.

As described above, the thin film protective film 14 is made of a material having an almost constant thermal expansion coefficient at a temperature of 1000° C. or lower and a melting point of 1000° C. or higher unlike the thick-film material having a glass transition temperature of 500 to 600° C. Therefore, even when printing paper slides in a state where the printing paper is pressed against the thermal head 100 by a platen roller, the thin film protective film 14 is less likely to be thermally deformed due to thermal stress at a peak temperature of 400 to 500° C. in the above-described high-speed printing, which makes it possible to provide a long-life thermal head 100 that is less likely to wear.

Further, as described above, the thin film protective film 14 has a high thermal conductivity of about 13.6 W/mK. Therefore, even when high-speed printing is performed, heat is quickly and evenly distributed in an area of the thin film protective film 14 corresponding to a position to which heat of the heat generator 1 is applied, and therefore heat does not accumulate. This makes it possible to provide high-quality printing without a defect such as tailing.

Third Embodiment

Hereinbelow, a thermal head 100 according to this embodiment will be described by focusing on a difference from the thermal head 100 according to the first embodiment.

Figure 4:
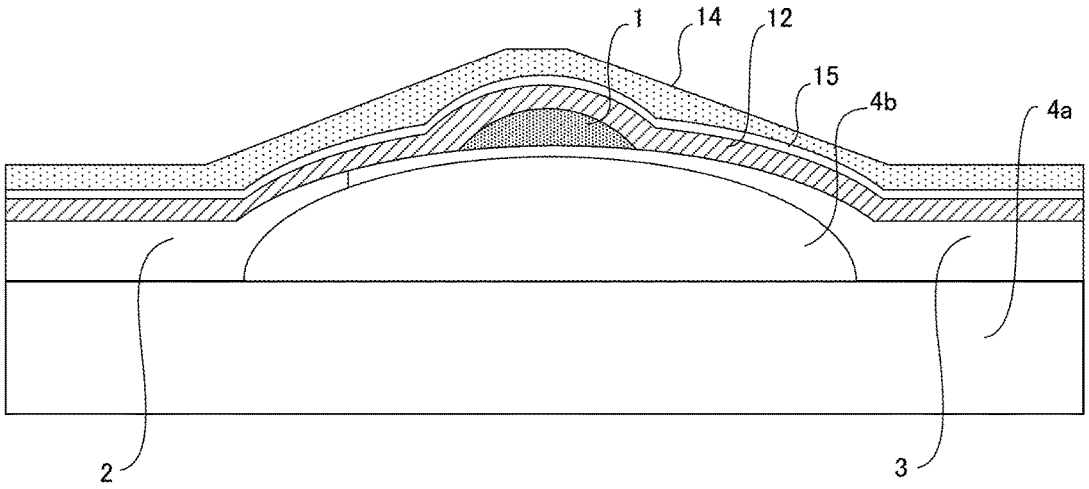
FIG. 4 is a schematic view showing the cross-section structure of a protective film in detail.

FIG. 4 is a schematic view showing the cross-section of an area near the heat generator 1. The thermal head 100 according to the third embodiment includes an intermediate layer 15 provided between the thick film protective film 12 and the thin film protective film 14. The intermediate layer 15 covers at least the same area as that covered by the thin film protective film 14. The intermediate layer 15 is mainly made of, for example, titanium, and has a thickness of about 0.05 to 0.5 μm.

As described above with reference to the second embodiment, there is a fear that the thin film protective film 14 peels off due to a local increase in internal stress in the thin film protective film 14.

In this embodiment, the intermediate layer 15 made of titanium having ductility is provided between the thin film protective film 14 and the thick film protective film 12, and therefore the internal stress of the thin film protective film 14 is relieved by the intermediate layer 15 so that adhesive force between the thin film protective film 14 and the thick film protective film 12 can be expected to improve. As a result, it is possible to provide the thermal head 100 having a longer lifetime.

The following modification is also within the scope of the present invention. One or more modified examples may be combined with any one of the above-described embodiments.

MODIFIED EXAMPLE 1

In the third embodiment, the thin film protective film 14 and the intermediate layer 15 are formed to be narrower than the thick film protective film 12 in the sub-scan direction. Therefore, an alignment mark may be provided in an area of the thick film protective film 12 on which the thin film protective film 14 and the intermediate layer 15 are not formed. This makes it possible to perform the positioning of the insulating substrate 4 having the heat generator 1 formed thereon on the support plate 5 with a high degree of accuracy.

The various embodiments and the modified example have been described above, but the present invention is not limited thereto. Other embodiments conceivable within the scope of the technical idea of the present invention are also encompassed within the scope of the present invention.

The disclosure of the following priority application is herein incorporated by reference: Japanese Patent Application No. 2017-186673 (filed on Sep. 27, 2017).

REFERENCE SIGNS LIST

100 Thermal head
1 Heat generator
2 Common electrode
3 Individual electrodes
4 Insulating substrate
6, 6*a*, 6*b* Driver ICs
7*a*, 7*b*, 7*c* Wires
8 Sealing resin
9 Circuit board
12 Thick film protective film
14 Thin film protective film

The invention claimed is:

1. A thermal head comprising:
an underglaze layer provided on an insulating substrate;
an electrode provided on the underglaze layer;
a heat generator provided on the electrode;
a first protective layer containing a glass material and covering at least the heat generator; and
a second protective layer provided on the first protective layer, having a melting point higher than that of the first protective layer, and made of a material whose thermal expansion coefficient at a temperature of 1000° C. or lower is substantially constant, wherein:
the second protective layer has a melting point of at least 1000° C. or higher, and
the first protective layer and the second protective layer have a thermal expansion coefficient of 6.0 to 7.0 ppm/° C.

2. The thermal head according to claim 1, wherein:
the second protective layer has a thermal conductivity of 10 W/mK or more.

3. The thermal head according to claim 2, wherein:
the second protective layer has a specific resistance of 100 μΩ·cm or less.

4. The thermal head according to claim 3, wherein:
the second protective layer is made of a material containing titanium and tungsten.

5. The thermal head according to claim 4, wherein:
the first protective layer has a thermal conductivity of more than 10 W/mK.

6. The thermal head according to claim 1, further comprising:
a third protective layer provided between the first protective layer and the second protective layer and having ductility higher than those of the first protective layer and the second protective layer.

7. The thermal head according to claim 6, wherein:
the third protective layer is made of a material containing titanium.

8. The thermal head according to claim 6, wherein:

in a printing surface of the thermal head, the second protective layer and the third protective layer are smaller in a width in a sub-scan direction than the first protective layer.

9. The thermal head according to claim 6, wherein:

the second protective layer and the third protective layer are formed as thin films by sputtering.

* * * * *